US005496675A

United States Patent [19]

Van Dusen et al.

[11] Patent Number: 5,496,675

[45] Date of Patent: Mar. 5, 1996

[54] CARRIER COATING AND PROCESSES

[75] Inventors: John G. Van Dusen, Walworth, N.Y.; Michael Cunningham, Georgetown, Canada; Bernard A. Kelly, Ontario, N.Y.

[73] Assignee: Xerox Corporation, Stamford, Conn.

[21] Appl. No.: 265,909

[22] Filed: Jun. 27, 1994

[51] Int. Cl.[6] ..... G03G 9/087; G03G 9/083; G03G 9/113; G03G 9/107

[52] U.S. Cl. ..... 430/137; 430/108; 427/221; 252/511; 252/502; 252/510

[58] Field of Search ..... 252/511, 502, 252/510; 430/137, 108; 427/221

[56] References Cited

U.S. PATENT DOCUMENTS

| | | | |
|---|---|---|---|
| 4,297,427 | 10/1981 | Williams et al. | 430/108 |
| 4,560,635 | 12/1985 | Hoffend et al. | 430/137 X |
| 4,935,326 | 6/1990 | Creatura et al. | 430/108 |
| 4,937,166 | 6/1990 | Creatura et al. | 430/108 |
| 5,043,404 | 8/1991 | Mahabadi et al. | 526/194 |
| 5,236,629 | 8/1993 | Mahabadi et al. | 252/511 |
| 5,264,314 | 11/1993 | Mahabadi et al. | 430/137 |
| 5,288,585 | 2/1994 | Mahabadi et al. | 430/137 |
| 5,330,874 | 7/1994 | Mahabadi et al. | 430/137 |

OTHER PUBLICATIONS

Reg. No. 24937–79–9, American Chemical Society, 1995.

Kirk–Othmer, *Encyclopedia of Chemical Technology,* 3rd ed., 1980, vol. 11, pp. 64–74.

*Primary Examiner*—Douglas J. McGinty

*Attorney, Agent, or Firm*—E. O. Palazzo

[57] ABSTRACT

A process for the preparation of conductive, electronegative, submicron polymeric particles comprised of a first polymer optionally containing from about 1 to about 50 percent by weight of a conductive filler and a second electronegative, contrast polymer, and wherein said conductive polymer particles with optional filler are prepared by mixing at least one monomer with a polymerization initiator, a crosslinking component and a chain transfer component; effecting bulk polymerization until from about 5 to about 50 weight percent of the monomer has been polymerized; terminating polymerization by cooling the partially polymerized monomer; adding thereto from about 1 to about 50 weight percent of a conductive filler or conductive fillers, followed by mixing thereof; dispersing the aforementioned mixture of conductive filler or fillers, and partially polymerized product in water containing a stabilizing component to obtain a suspension of particles with an average diameter of from about 0.05 to about 1 micron in water; polymerizing the resulting suspension by heating; adding a second contrast polymer emulsion, suspension or fine dispersion with high shear mixing; and optionally subsequently washing and drying the polymer particles obtained.

27 Claims, No Drawings

CARRIER COATING AND PROCESSES

BACKGROUND OF THE INVENTION

This invention is generally directed to carrier particles, and more specifically the present invention relates to processes for the preparation of conductive carrier particles, wherein the conductivity is, for example, from about $10^{-2}$ to about $10^{-10}$ (ohm-cm)$^{-1}$ by the coating of carrier cores with submicron, conductive polymeric particles. This invention also relates to processes for the preparation of submicron, conductive polymeric particles comprised of a polymer containing conductive filler blended with a second polymer, such as a methacrylate polymer containing carbon black blended with a fluoropolymer. In embodiments, the present invention comprises contrast carrier coatings with minimal conductivity loss by the preparation of a blend of an emulsion, suspension or fine dispersion of an electronegative charging, contrast polymer, such as a fluoropolymer, with a polymer of, for example, polymethylmethacrylate containing carbon black, also in suspension. In embodiments, the present invention is directed to processes for the preparation of carrier particles and, more specifically, coatings thereof by first polymerizing a monomer like methyl methacrylate in the presence of carbon black in a stabilized suspension and thereafter accomplishing high speed stirring thereof while an emulsion or suspension of a contrast polymer, especially of submicron in size, is added. Subsequently, the aforementioned resulting mixture is condensed and dried to yield a fine powder and thereafter this powder is coated on a carrier core like steel, ferrite, and the like by rotary kiln fusing. In embodiments, the process of the present invention comprises the preparation of conductive carrier particles by mixing submicron, less than 1 micron in average volume diameter for example, polymer particles containing carbon black, followed by the addition of an aqueous emulsion, suspension or fine dispersion of 0.05 to about 1 micron size average volume diameter particles of a contrast polymer, like polyvinylidenefluoride, drying this blend of polymeric particles, for example, by fluidized bed drying, and applying by dry coating methods the resulting mixture to carrier cores of, for example, steel, iron, ferrites, and the like; and thereafter fusing by heating the polymer mixture onto the carrier cores.

The conductivity of the generated submicron polymeric composite particles can be modified by, for example, varying the weight percent of conductive filler component like carbon black present in effective amounts of, for example, from between about 1 weight percent to about 50 weight percent, and also by varying the composition of the conductive filler component. Thus, conductive submicron polymeric composite particles with a conductivity of from between about $10^{-10}$ (ohm-cm)$^{-1}$ to about $10^{-4}$(ohm-cm)$^{-1}$ can be prepared. In one process embodiment, the particles with average diameter of about 0.05 to about 1 micron of conductive composite particles are comprised of polymers and a conductive filler distributed throughout the polymer matrix of the composite product, and which product can be obtained by a semisuspension polymerization method as illustrated in U.S. Pat. No. 5,043,404, the disclosure of which is totally incorporated herein by reference. In the aforementioned semisuspension polymerization processes, a mixture of monomers or comonomers, a polymerization initiator, a crosslinking component and a chain transfer component are bulk polymerized until partial polymerization is accomplished, for example. In one specific embodiment of the present invention, from about 10 to about 50 percent of monomers or comonomers are converted to polymer, thereafter the resulting partially polymerized monomers or comonomers are cooled to cease bulk polymerization, and to the cooled mixture of polymerized monomers or comonomers is added carbon black like those carbon blacks available from Cabot Corporation, such as REGAL 330®, followed by mixing using, for example, a high shear mixer until a homogeneous, organic phase is obtained, Subsequently, the resulting organic phase is dispersed in water containing a stabilizing component with, for example, a high shear mixer, then the resulting suspension is transferred to a reactor and completely polymerized, the contents of the polymerization reactor are then cooled, followed preferably by washing and drying the polymer product. The polymer product obtained can then be applied to a carrier core by the dry coating processes illustrated herein, reference U.S. Pat. Nos. 4,937,166 and 4,935,326, the disclosures of which are totally incorporated herein by reference.

Metals such as carrier cores can be conductive or semiconductive materials, and the polymeric materials used to coat the surface of metals are usually insulating. Therefore, carrier particles coated completely with a polymer or a mixture of polymers can lose their conductivity and become insulating. Although this is desired for some applications, for conductive magnetic brush systems (CMB) the carrier particles should be conductive. Since the carrier polymer coating can be utilized to control carrier tribo, a conductive carrier coating is needed to design carriers with the desired conductivity and triboelectrical properties. Conductive polymers are very costly, and may not be considered suitable for preparing low cost, for example less than $5/pound, coating, thus a conductive polymer composite comprising a low cost polymer and a conductive filler, such as conductive carbon black, avoids these disadvantages.

A polymer composite coating of metal materials, such as carrier beads, can be obtained by two general approaches, solution and powder coating. Solution coating of carriers using a polymer composite solution comprised of a polymer, a conductive filler and a solvent can be utilized to prepare conductive carrier, however, trapping of solvent in the solution coating adversely interferes with the use of coated materials, for example the residual solvent trapped in the carrier coating reduces the carrier life, and the release of solvent in the developer housing can cause other problems related to harmful effects of absorbed solvent to various copying machine parts and toxicity of solvent. Moreover, the solvent recovery operation involved in the solution coating processes is costly. The powder coating of metal surfaces can eliminate the need for solvent, and therefore, many of the problems associated with solution coating; however, such coating requires polymer powder with a very small size, for example less than one micron. Although several polymer powders with desired particle size are available for carrier powder coating, submicron polymer composite particles containing conductive filler to prepare conductive coated carriers that maintain their triboelectrical characteristics for extended time periods exceeding, for example, 200,000 images are not believed to be known. Therefore, there is a need for conductive submicron polymeric composite particles each containing a conductive filler distributed evenly throughout particles and processes for the preparation thereof.

The preparation of polymeric particles for powder coatings can be accomplished by, for example, three methods, namely grinding or attrition, precipitation and in situ particle polymerization. Grinding or attrition, especially fluid energy milling, of large polymeric particles or polymeric composite particles containing fillers to the size needed for powder coating, for example less than one micron, is often not desirable both from an economic and functional viewpoint. These materials are difficult to grind, and with present milling equipment are costly due to very low processing yield, for example in the range of 5 to 10 weight percent. In one precipitation method, the polymer solution is heated to above its melting temperature and then cooled to form particles. In another process, the polymer solution is precipitated using a nonsolvent, or the polymer solution is spray dried to obtain polymeridpolymeric composite particles. With these precipitation processes, it is difficult to achieve low cost and clean, that is for example with no or substantially no impurities, such as solvents or precipitants, in the resulting polymer particles. It is also difficult with these processes to obtain particles with small particle size and narrow particle size distribution. Further, with these processes it can be difficult to control filler distribution throughout each particle's polymer matrix. In the in situ particle polymerization process, polymer particles can be prepared by utilizing suspension dispersion, emulsion and semisuspension polymerization. Suspension polymerization can be utilized to prepare polymer particles and polymeric composite particles containing, for example, a conductive filler. However, this process does not, for example, effectively enable particles with a size less than about five microns. Although emulsion and dispersion polymerization may be utilized to prepare polymeric particles of small size, for example less than one micron, processes wherein particle formation is achieved by nucleation and growth do not effectively enable synthesis of particles containing fillers such as conductive fillers. Conductive fillers, such as carbon blacks, are free radical polymerization inhibitors terminating or at least reducing the rate of polymerization.

There is disclosed in U.S. Pat. No. 4,908,665 a developing roller or developer carrier comprised of a core shaft, a rubber layer and a resin coating layer on the surface of the rubber containing conductive fillers for a one component developer. It is indicated in the '665 patent that the conductive developing roller can eliminate variation of the image characteristic due to the absorption of moisture for one component development. U.S. Pat. No. 4,590,141 discloses carrier particles for two component developer coated with a layer of silicon polymer using fluidized bed solution coating. U.S. Pat. No. 4,562,136 discloses a two component dry type developer which comprises carrier particles coated with a silicon resin containing a monoazo metal complex. The two component carriers described in the above two patents are insulating, that is with a conductivity of less than $10^{-10}$ $(\text{ohm-cm})^{-1}$ and are not believed to be conductive. There is disclosed in U.S. Pat. No. 4,912,005 a conductive carrier composition coated with a layer of resin containing a conductive particle by solution coating, and wherein residual solvent trapped in the coated layer adversely effects the maintainability of carrier electrical properties for an extended time period.

There is disclosed in U.S. Pat. No. 3,505,434 a process wherein particles for fluidized bed powder coating are prepared by dispersing the polymer in a liquid which is heated to above the polymer melting point and stirred causing the polymer particles to form. The particles are then cooled below their melting point and recovered. However, this process does not, for example, effectively enable particles with a size of below 50 microns in diameter.

The suspension polymerization of monomer is known for the formation of polymer/polymeric composite particles generally in a size range of about 200 microns and higher. The main advantage of suspension polymerization is that the product may easily be recovered, therefore, such a process is considered economical. However, it is very difficult by suspension polymerization to prepare very small particles as the monomer droplets tend to coalesce during the polymerization process, especially in the initial stage of polymerization where the droplets are very sticky. For example, there is disclosed in U.S. Pat. No. 3,243,419 a method of suspension polymerization wherein a suspending agent is generated during the suspension polymerization to aid in the coalescence of the particles. Also disclosed in U.S. Pat. No. 4,071,670 is a method of suspension polymerization wherein the monomer initiator mixture is dispersed in water containing stabilizer by a high shear homogenizer, followed by polymerization of suspended monomer droplets.

Further, disclosed in U.S. Pat. No. 4,835,084 is a method for preparing pigmented particles wherein a high concentration of silica powder is utilized in the aqueous phase to prevent coalescence of the particles. There is also disclosed in U.S. Pat. No. 4,833,060 a process for the preparation of pigmented particles by dissolving polymer in monomer and dispersing in an aqueous phase containing silica powder to prevent coalescence of the particles. However, the silica powder used in both U.S. Pat. Nos. '084 and '060 should be removed using a bask like potassium hydroxide (KOH) which is costly, and residual KOH and silica materials left on the surface can adversely affect the charging properties of particles. Moreover, the above processes will not effectively enable the preparation of submicron conductive particles. There is also disclosed in U.S. Pat. No. 3,954,898 a two step polymerization process for the preparation of a thermosetting finished powder. However, this process does not enable synthesis of particles with a size less than 100 microns.

Disclosed in U.S. Pat. No. 5,043,404 the disclosure of which is totally incorporated herein by reference, is a semisuspension polymerization process for the preparation of small polymeric particles which are comprised of a mixture of monomers or comonomers, a polymerization initiator, a crosslinking component and a chain transfer component which are bulk polymerized until partial polymerization is accomplished. The resulting partially polymerized monomers or comonomers are dispersed in water containing a stabilizer component with, for example, a high shear mixer, then the resulting suspension polymerized, followed by washing and drying the submicron polymeric particles.

Illustrated in copending patent application U.S. Pat. No. 5,330,874, the disclosure of which is totally incorporated herein by reference, is a process for the preparation of carrier particles which comprises the dry coating of a carrier core or carrier cores with conductive submicron polymeric particles containing from about 1 to about 50 weight percent of conductive fillers, and wherein said conductive polymer particles are prepared by mixing at least one monomer with a polymerization initiator, a crosslinking component and a chain transfer component; effecting bulk polymerization until from about 5 to about 50 weight percent of the monomer has been polymerized; terminating polymerization by cooling the partially polymerized monomer; adding thereto from about 1 to about 50 weight percent of a conductive filler or conductive fillers, followed by mixing thereof; dispersing the aforementioned mixture of conductive filler or fillers, and partially polymerized product in water containing a stabilizing component to obtain a suspension of particles with an average diameter of from about 0.05 to about 1 micron in water; polymerizing the resulting suspension by heating; subsequently washing and drying the product; thereafter heating the carrier core or carrier cores and the resulting conductive polymer particles to enable fusing thereof to the core or cores; and cooling the carrier particles obtained, which particles have a conductivity of from between about $10^{-4}$ to about $10^{-10}$ (ohm-cm)$^{-1}$.

Illustrated in U.S. Pat. No. 5,236,629 the disclosure of which is totally enclosed herein by reference, is a process for the preparation of conductive submicron polymeric particles consisting essentially of mixing at least one monomer with a polymerization initiator, a crosslinking component and a chain transfer component; effecting bulk polymerization until from about 10 to about 50 weight percent of the monomer has been polymerized; terminating polymerization by cooling the partially polymerizaed monomer; adding thereto from about 1 to about 50 weight percent of a conductive filler, or conductive fillers, followed by mixing thereof; dispersing the aforementioned mixture of conductive filler or fillers, and partially polymerized product in water containing a stabilizing component selected from the group consisting of nonionic and ionic water soluble polymeric stabilizers to obtain a suspension of particles with an average diameter of from about 0.05 to about 1 micron in water; polymerizing the resulting suspension by heating; and subsequently washing and drying the product.

Advantages of the process of the present invention include the addition of electrical contrast behavior to the conductive coating while minimizing losses in the coating's conductivity; for example less than 1 to 2 orders of magnitude in comparison to common decreases in conductivity of 4 to 10 orders of magnitude when using other known blending/powder coating methods. The blending of a normally insulating contrast material like poly(vinylidenefluoride) as submicron suspensions with the conductive semisuspension particles provides an excellent means of obtaining a stable conductive carrier coating. Also, advantages associated with the present invention, in embodiments include stable preselected electrical characteristics, including essentially the same carrier conductivity irrespective of the polymer coating weight or electronegativity. Use of toxic solvents, and the recovery thereof can be eliminated, and the adverse effects of residual solvent on carrier conductivity is avoided, or minimized.

SUMMARY OF THE INVENTION

It is, therefore, an object of this invention to provide processes for the preparation of carrier particles with many of the advantages illustrated herein.

In another object of the present invention there are provided processes for the preparation of conductive carrier particles by the dry coating of conductive submicron polymeric composites comprised of a contrast polymer and a second polymer containing a conductive filler distributed evenly throughout the polymer matrix of the composite and fusing by heating the aforementioned composite to the carrier core.

In yet another object of the present invention there are provided processes for the preparation of conductive carrier particles by the dry coating of conductive submicron polymeric mixtures comprised of dry conductive submicron polymeric composite particles comprised of from about 1 to about 99 weight percent of a polymer containing from about 1 to 50 percent of a conductive filler, and 1 to 99 percent of a contrast polymer.

Another object of the present invention resides in carrier particles coated with conductive submicron polymeric composite particles with a conductivity of from about $10^{-10}$ (ohm-cm)$^{-1}$ to about $10^{-2}$ (ohm-cm)$^{-1}$ and processes for the preparation thereof.

Another object of the present invention resides in the preparation of carrier particles with conductive submicron polymeric composite particles with an average particle diameter size of from about 0.05 micron to about 1 micron.

Also, in another object of the present invention there are provided simple and economical processes for the formation of conductive submicron polymeric particles that can be selected as carrier coatings, reference U.S. Pat. Nos. 4,937,166 and 4,935,326, the disclosures of which are totally incorporated herein by reference.

Additionally, in another object of the present invention there are provided as a result of the enhanced degree of control and flexibility processes for the preparation of conductive carrier particles comprised of polymeric particles and containing a conductive filler, or fillers with improved flow and fusing properties; and with a triboelectric charge in the range, for example, of from about −40 to about + 40 microcoulombs per gram as determined by the known Faraday Cage process.

Further, another object of the present invention resides in the preparation of conductive contrast coatings for xerographic carrier, which processes involve the polymerization of a monomer like methyl methacrylate in the presence of a component like carbon black, followed by selecting high speed stirring while adding an emulsion of a submicron size, 0.05 to less than 1 micron, polymer, such as a fluoropolymer. The mixture resulting is then dried and coated onto a carrier core in, for example, a rotary kiln, and wherein the surface conductivity thereof can be controlled.

These and other objects of the present invention can be accomplished in embodiments by the provision of processes for the preparation of carrier particles by initially mixing submicron conductive polymer particles containing conductive filler or fillers distributed evenly throughout the polymer matrix of particles, referred to as semisuspension polymerization processes in which a mixture of monomers or comonomers, a polymerization initiator, an optional crosslinking component and an optional chain transfer component is bulk polymerized until partial polymerization is accomplished, for example from about 10 to about 50 percent of monomers or comonomers are converted to polymer. The bulk polymerization is terminated by cooling the partially polymerized monomers or comonomers. To the stirred partially polymerized product, there is then added a conductive filler, followed by mixing thereof with, for example, a high shear homogenizer, such as a Brinkmann homogenizer, to prepare a mixture or organic phase. The viscosity of the organic phase can in embodiments be an important factor in controlling dispersion of the conductive filler in the particles, and this viscosity can be adjusted by the selected percentage of polymer in the mixture. The aforementioned partially polymerized product with filler is then dispersed in water containing a stabilizing component with, for example, a high shear mixer to permit the formation of a suspension containing small, less than 1 micron, and, for example, 0.1 to 0.9 micron in average volume diameter particles therein, and thereafter, transferring the resulting suspension product to a reactor, followed by polymerization until complete conversion to the polymer mixture product is achieved. An aqueous emulsion, suspension or fine dispersion of an electronegative contrast polymer, such as a fluoropolymer, is then added to the suspension using either a continuous or batch high shear blender or homogenizer operating at 5,000 to 20,000 rpm. The product can then be cooled, washed and dried, and subsequently the formed composite can be dry coated onto a carrier core followed by heat fusing thereto and cooling. More specifically, the process of the present invention is comprised of (1) mixing monomers or comonomers with polymerization initiators, a crosslinking component and a chain transfer component; (2) effecting bulk polymerization by increasing the temperature of the aforementioned mixture to from about 45° C. to about 120° C. until from about 10 to about 50 weight percent of monomers or comonomers has been polymerized; the molecular weight of polymer in the bulk or the percentage of polymer present in the mixture which affects the viscosity of the partially polymerized monomers or comonomers is an important factor in controlling conductive filler distribution in the particles; (3) cooling the partially polymerized monomers or comonomers and adding a conductive filler like carbon black, followed by mixing thereof with, for example, a high shear homogenizer to form an organic phase; (4) dispersing the resulting organic phase in from about 2 to about 5 times its volume of water containing from about 1 to about 5 weight percent of a stabilizing component to form a suspension with a particle size diameter of from about 0.05 micron to about 1 micron containing from about 1 to about 50 weight percent of a conductive filler, or conductive fillers using a high shear mixer; (5) transferring the resulting suspension to a reactor and polymerizing the suspension by increasing its temperature to from about 45° C. to about 120° C. to allow the complete conversion of monomers or comonomers to polymer, and thereafter adding an aqueous emulsion, suspension or fine dispersion of a contrast polymer with high shear mixing to provide a uniform blend of the two types of polymeric particles; (6) cooling the product and washing the product with water and/or an aliphatic alcohol like methanol; (7) separating polymer particles from the water/methanol by means of filtration or centrifugation; (8) drying the polymeric particles; (9) applying the dried polymeric composite particles comprised of a first polymer containing a conductive filler and a fluoropolymer to a carrier core by dry powder mixing to enable the polymer coating, or coatings to electrostatically adhere and/or mechanically attach to the core, followed by heating, preferably at about 100° C. to about 500° C.; and (10) thereafter heat fusing the composite polymer to the carrier core followed by cooling. The contrast polymer emulsion, preferably in embodiments, is comprised of a fluoropolymer emulsion commercially available, for example polyvinylidene fluoride, obtained as a 0.2 micron emulsion from ELF-Atochem, of Philadelphia, Pa., known as KYNAR®3200.

The preparation of the polymeric particles comprises mixing at least one monomer with a polymerization initiator, a crosslinking component and a chain transfer component; effecting bulk polymerization until from about 10 to about 50 weight percent of the monomer has been polymerized; adding a conductive filler thereto and mixing; dispersing the aforementioned product in water containing a stabilizing component to obtain a suspension of particles with an average diameter of from about 0.05 to about 1 micron in water; polymerizing the resulting suspension; mixing the suspension of conductive particles with the desired amount of an aqueous emulsion, suspension or fine dispersion of an electronegative contrast polymer, that is a polymer having a contrasting triboelectric behavior to the conductive polymer with filler, using a high shear mixer. The weight ratio of conductive polymer particles to contrast polymer particles is the range of from 100/1 to 100/1,000, and more preferably from 100/10 to 100/200. By at least one monomer it is intended to include from about 2 to about 20 monomers, comonomers thereof, and the like. Throughout "from about to about" includes between the ranges provided. The resulting small conductive polymeric particles possess, for example, an average particle diameter in the range of from about 0.05 micron to about 1 micron, and preferably from about 0.1 to about 0.8 micron as measured by SEM containing 1 to about 50 percent and preferably 10 to 20 percent of conductive filler like carbon black distributed throughout the polymer matrix of particles, and which particles have a number and weight average molecular weight of from between about 5,000 to about 500,000 and from between about 10,000 to about 2,000,000, respectively, in embodiments. The contrast polymer particles have a number and weight average molecular weight of from between about 5,000 to about 500,000 and from between about 10,000 to about 2,000,000 respectively.

The polymeric particles containing conductive filler can be comprised of two linear and crosslinked portions with a number average molecular weight of the linear portion being from about 5,000 to about 50,000 and a weight average molecular weight of from about 100,000 to about 500,000, and from 0.1 to about 5 weight percent of a crosslinked portion, and which polymer product is useful for carrier coatings. More specifically, the conductive polymeric particles have an average diameter in the range of between about 0. 1 to about 0.8 micron with conductive filler distributed evenly throughout polymer matrix as measured by TEM, and wherein the polymer contains a linear portion having a number average molecular weight in the range of from about 5,000 to about 50,000, and a weight average molecular weight of from about 100,000 to about 500,000, and from about 0.1 to about 5 weight percent of a crosslinked portion. In embodiments, the process of the present invention comprises (1) mixing monomers or comonomers with a polymerization initiator with the ratio of monomers or comonomers to initiator being from about 100/2 to about 100/20, a crosslinking component with the ratio of monomers or comonomers to crosslinking component being from about 100/0.1 to about 100/5, and a chain transfer component with the ratio of monomers or comonomers to the chain transfer component being from about 100/0.01 to about 100/1; (2) effecting bulk polymerization by increasing the temperature of the mixture to from about 45° C. to about 120° C. until from about 10 to about 50 weight percent of monomers or comonomers has been converted to polymer with a number average molecular weight of from about 5,000 to about 50,000 and a weight average molecular weight of from about 10,000 to about 40,000, and thereafter, adding conductive filler thereto with the ratio of filler to polymer monomer mixture being from about 0. 1 to about 0.2, followed by extensive mixing to prepare an organic phase; (3) dispersing the resulting organic phase from about 2 to about 5 times its volume in water containing from about 1 to about 5 weight percent of a stabilizing component, preferably polyvinylalcohol having a weight average molecular weight of from 1,000 to about 10,000 to form a suspension containing particle with a particle size diameter of from 0. 1 to about 0.8 micron by using high shear mixer; (4) transferring the resulting suspension to a reactor and polymerizing the suspension by increasing its temperature to from about 45° C. to about 120° C. to allow the complete conversion of monomers or comonomers to polymer; (5) adding to the formed suspension of conductive polymeric particles an aqueous emulsion, suspension or fine dispersion of a contrast polymer, for example KYNAR 3200, and mixing using a high shear mixer to produce a uniform blend of the conductive polymer particles and the contrast polymer particles; (6) washing the resulting product with equal volumes of methanol and/or water from about 3 to about 5 times; (7) separating polymeric particles from the water/methanol by means of filtration or centrifugation; and (8) drying of the resulting blend of conductive polymeric particles and contrast polymer particles.

Embodiments of the present invention are directed to a process for the preparation of conductive, electronegative, submicron polymeric particles comprised of a first polymer optionally containing from about 1 to about 50 percent by weight of a conductive filler and a second electronegative, contrast polymer, and wherein said conductive polymer particles with optional filler are prepared by mixing at least one monomer with a polymerization initiator, a crosslinking component and a chain transfer component; effecting bulk polymerization until from about 5 to about 50 weight percent of the monomer has been polymerized; terminating polymerization by cooling the partially polymerized monomer; adding thereto from about 1 to about 50 weight percent of a conductive filler or conductive fillers, followed by mixing thereof; dispersing the aforementioned mixture of conductive filler or fillers, and partially polymerized product in water containing a stabilizing component to obtain a suspension of particles with an average diameter of from about 0.05 to about 1 micron in water; polymerizing the resulting suspension by heating; adding a second contrast polymer emulsion, suspension or fine dispersion with high shear mixing; and optionally subsequently washing and drying the polymer particles obtained.

Illustrative examples of monomers or comonomers present in an amount of, for example, from about 80 to about 99 weight percent include vinyl monomers comprised of styrene and its derivatives such as styrene, α-methylstyrene, p-chlorostyrene ,and the like; monocarboxylic acids and their derivatives such as acrylic acid, methyl acrylate, ethyl acrylate, butyl acrylate, dodecyl acrylate, octyl acrylate, phenyl acrylate, methacrylic acids, methyl methacrylate, ethyl methacrylate, butyl methacrylate, octyl methacrylate, acrylonitrile and acrylamide; dicarboxylic acids having a double bond and their derivatives such as maleic acid, monobutyl maleate, dibutyl maleate; vinyl esters such as vinyl chloride, vinyl acetate and vinyl benzoate; vinyl ketones such as vinyl methyl ketone and vinyl ether ketone; vinyl ethyl ether and vinyl isobutyl ether; vinyl naphthalene; unsaturated mono-olefins such as isobutylene and the like; vinylidene halides such as vinylidene chloride and the like; N-vinyl compounds such as N-vinyl pyrrole and fluorinated monomers such as pentafluoro styrene, allyl pentafluorobenzene and the like; and mixtures thereof.

Illustrative examples of polymerization initiators present in an amount of, for example, from about 0.1 to about 20 weight percent of monomer include azo compounds such as 2,2'-azodimethylvaleronitrile, 2,2'-azoisobutyronitrile, azobiscyclohexanenitrile, 2-methylbutyronitrile and the like, and peroxide such as benzoyl peroxide, lauryl peroxide, 1-1-(t-butylperoxy)-3,3,5-trimethylcyclohexane, n-butyl-4, 4-di-(t-butylperoxy) valerate, dicumyl peroxide and the like.

Crosslinkers selected are known and can be comprised of compounds having two or more polymerizable double bonds. Examples of such compounds include aromatic divinyl compounds such as divinylbenzene and divinylnaphthalene; carboxylic acid esters having two double bounds such as ethylene glycol diacrylate, ethylene glycol dimethylacrylate and the like; divinyl compounds such as divinyl ether, divinyl sulfite, divinyl sulfone and the like. Among these, divinylbenzene is particularly useful. The crosslinking component is preferably present in an amount of from about 0.1 to about 5 parts by weight in 100 parts by weight of monomers or comonomers mixture.

Examples of conductive fillers present in effective amounts as illustrated herein include, for example, conductive carbon blacks such as acetylene black, available from Chevron Chemical, VULCAN BLACK™, BLACK PEARL L®, KEYTJEN BLACK EC600JD®, available from Akzo Chemical, CONDUCTEX SC ULTRA™, available from Columbian Chemical, metal oxides such as iron oxides, TiO, $SnO_2$ and metal powders such as iron powder.

Stabilizers present in an amount of, for example, from about 0.1 to about 5 weight percent of water include both nonionic and ionic water soluble polymeric stabilizers such as methyl cellulose, ethyl cellulose, hydroxypropyl cellulose, block copolymers such as PLURONIC E87™ available from BASF, the sodium salt of carboxyl methyl cellulose, polyacrylate acids and their salts, polyvinyl alcohol, gelatins, starches, gums, alginates, zein and casein, and the like; and barrier stabilizers such as tricalcium phosphate, talc, barium sulfate, and the like. Polyvinyl alcohol with a weight average molecular weight of from about 1,000 to about 10,000 is particularly useful.

Chain transfer components selected, which primarily function to control molecular weight by inhibiting chain growth, include mercaptans such as laurylmercaptan, butylmercaptan and the like, or halogenated carbons such as carbon tetrachloride or carbon tetrabromide, and the like. The chain transfer agent is preferably present in an amount of from about 0.01 to about 1 weight percent of monomer or comonomer mixture. Also, stabilizer present on the surface of the polymeric particles can be washed using an alcohol such as, for example, methanol and the like, or water. Separation of washed particles from solution can be achieved by any classical separation techniques such as filtration, centrifugation and the like. Classical drying techniques, such as vacuum drying, freeze drying, spray drying, fluid bed drying and the like, can be selected for drying of the polymeric particles.

Illustrative specific examples of polymers or copolymers present in an amount of about 50 to about 99 weight percent containing, for example, both a linear and a crosslinked portion in which the ratio of crosslinked portion to linear portion is from about 0.001 to about 0.05 and the number and weight average molecular weight of the linear portion is from about 5,000 to about 500,000 and from about 10,000 to about 2,000,000, respectively, include vinyl polymers of polystyrene and its copolymers, polymethylmethacrylate and its copolymers, unsaturated polymers or copolymers such as styrene-butadiene copolymers, fluorinated polymers or copolymers, such as polypentafluorostyrene, polyallylpentafluorobenzene, and the like.

Various suitable solid core carrier materials can be selected. Characteristic core properties of importance include those that will enable the toner particles to acquire a positive charge or a negative charge, and carrier cores that will permit desirable flow properties in the developer reservoir present in the xerographic imaging or printing apparatus. Also of value with regard to the carrier core properties are, for example, suitable magnetic characteristics that will permit magnetic brush formation in magnetic brush development processes; and also wherein the carrier cores possess desirable mechanical aging characteristics. Examples of carrier cores that can be selected include iron, steel, ferrites, magnetites, nickel, and mixtures thereof. Preferred carrier cores include ferrites and sponge iron, or steel grit with an average particle size diameter of from between about 30 microns to about 200 microns.

Illustrative examples of polymer coating mixtures that can be selected for the carrier particles of the present invention include those that are not in close proximity in the triboelectric series. Specific examples of polymer mixtures used are polyvinylidenefluoride with polymethylmethacrylate; copolyethylenevinylacetate; copolyvinylidenefluoride tetrafluoroethylene and polyethylene; polymethylmethacrylate and copolyethylene-vinylfluoride; and polymethylmethacrylate and polyvinylfluoride. Other related polymer mixtures not specifically mentioned herein can be selected providing the objectives of the present invention are achieved, including for example polystyrene and tetrafluoroethylene; polyethylene and tetrafluoroethylene; polyethylene and polyvinyl chloride; polyvinyl acetate and tetrafluoroethylene; polyvinyl acetate and polyvinyl chloride; polymethylmethacrylate and poly(p-fluorostyrene); and poly(N-vinyl carbazole and polymethyl methacrylate.

Also, there results, in accordance with the present invention in embodiments, carrier particles of relatively constant conductivities of from between about $10^{-4}$ (ohm-cm)$^{-1}$ to about $10^{-10}$ (ohm-cm)$^{-1}$ at, for example, a 10 volt impact across a 0.1 inch gap containing carrier beads held in place by a magnet; and wherein the carrier particles are of a triboelectric charging value of from +30 microcoulombs per gram to −40 microcoulombs per gram, these parameters being dependent on the coatings selected, and the percentage of each of the polymers used as indicated hereinbefore. Coating weights can vary, and effective amounts include, for example, from about 0.7 to about 1 weight percent in embodiments.

Various effective suitable means can be used to apply the polymer composite coatings to the surface of the carrier particles. Examples of typical means for this purpose include combining the carrier core material, and the mixture of polymers by cascade roll mixing, or tumbling, milling, shaking, electrostatic powder cloud spraying, fluidized bed, electrostatic disc processing, electrostatic curtain and the like. Following application of the polymer mixture, heating is initiated to permit flowout of the coating material over the surface of the carrier core. The concentration of the coating material powder particles, and the parameters of the heating step may be selected to enable the formation of a continuous film of the coating material on the surface of the carrier core, or permit only selected areas of the carrier core to be coated. When selected areas of the metal carrier core remain uncoated or exposed, the carrier particles will possess electrically conductive properties when the core material comprises a metal. The aforementioned conductivities can include various suitable values. Generally, however, this conductivity is from about $10^{-4}$ to about $10^{-10}$ (ohm-cm)$^{-1}$ as measured, for example, across a 0.1 inch magnetic brush at an applied potential of 10 volts, and wherein the coating coverage encompasses from about 10 percent to about 100 percent of the carrier core.

The developer compositions (toner and carrier) may be selected for use in electrostatographic imaging processes containing therein conventional photoreceptors, including inorganic and organic photoreceptor imaging members. Examples of imaging members are selenium, selenium alloys, and selenium or selenium alloys containing therein additives or dopants such as halogens. Furthermore, there may be selected organic photoreceptors, illustrative examples of which include layered photoresponsive devices comprised of transport layers and photogenerating layers, reference U.S. Pat. No. 4,265,990, the disclosure of which is totally incorporated herein by reference, and other similar layered photoresponsive devices. Moreover, the developer compositions with carriers obtained with the processes of the present invention are particularly useful in electrostatographic imaging processes and apparatuses wherein there is selected a moving transporting means and a moving charging means; and wherein there is selected a deflected flexible layered imaging member, reference U.S. Pat. Nos. 4,394,429 and 4,368,970, the disclosures of which are totally incorporated herein by reference.

With further reference to the process for generating the carrier particles illustrated herein, there is initially obtained, usually from commercial sources, the uncoated carrier core, and the submicron polymer composite powder mixture coating is prepared as illustrated herein. The individual components for the coating are available, for example, from ELF-Atochem as 301F KYNAR®, Allied Chemical as POLYMIST B6™, and other sources. Thereafter, the carrier core polymer blend is incorporated into a mixing apparatus, about 1 percent by weight of the polymer blend with conductive components therein to the core by weight, and mixing is affected for a sufficient period of time until the polymer blend is uniformly distributed over the carrier core, and mechanically or electrostatically attached thereto. Subsequently, the resulting coated carrier particles are metered into a rotating tube furnace, which is maintained at a sufficient temperature to cause melting and fusing of the polymer blend to the carrier core of, for example, steel, iron, ferrites, and other known cores.

The following Examples are being submitted to further define various species of the present invention. These Examples are intended to be illustrative only and are not intended to limit the scope of the present invention. Also, parts and percentages are by weight unless otherwise indicated.

EXAMPLE I

To 120 grams of methyl methacrylate monomer were added 8 grams of 2,2'-azobis(2,4-dimethyl valeronitrile), 3.2 grams of benzoyl peroxide and 0.6 gram of divinyl benzene crosslinking agent, followed by mixing in a one liter flask using a mechanical stirrer until dissolved. This mixture was bulk polymerized by heating in a one liter glass reactor to 45° C. by means of a water bath, while the mixture in the reactor was stirred with a TEFLON® propeller until 15 weight percent of the monomer was converted to polymer. The reactor was then removed from the water bath and cooled to about 0° C. by means of an ice bath. Thirty grams of Columbian CONDUCTEX SC ULTRA™ carbon black were added and stirred until all the carbon black was wetted. The resulting organic phase was then poured, together with 400 milliliters of water containing 4 weight percent of polyvinyl alcohol having a weight average molecular weight of 3,000, into a two liter stainless steel beaker. The beaker was then placed in an ice bath and using a Brinkmann PT456G polytron homogenizer the resulting mixture was then vigorously stirred at 10,000 revolutions per minute for 5 minutes to produce a microsuspension of polymeric particles containing carbon black in water. A quantity of 0.2 gram of potassium iodide was then added as an aqueous phase inhibitor. The resulting microsuspension was transferred to a 1 liter stainless steel reactor with an aluminum block heater and cold water coil cooling. The suspension polymerization temperature was raised from 25° to 60° C. in 35 minutes where it was held for 2 hours, then the temperature was increased to 85° C. in 120 minutes and held there for 1 hour. To this suspension were added 556 grams of an emulsion of the contrast polymer KYNAR 3200®(18 weight percent solids) with high shear mixing for five minutes after which the suspension was cooled in 30 minutes to 25° C. The ratio of conductive polymethylmethacrylate particles to KYNAR® particles used was 100/67. The resulting microsuspension product was then washed with 1,200 grams of methanol and centrifuged. The resulting supernatant liquid comprised of the diluted polyvinyl alcohol was decanted, fresh methanol/water, 50:50 ratio, was added, and the mixture was mixed for 1 to 2 minutes at 5,000 revolutions per minute. This washing procedure was again repeated with deionized water. After the final wash, the product was freeze dried to provide dry individual particles. Scanning electron microscope (SEM) photomicrographs of the dry product indicated the average volume diameter particle size of the conductive polymer product was 0.7 micron. The carbon black content of the product as measured by TGA was 16.5 percent. The product conductivity was measured by melting one gram of product in the form of a film, and using a conductivity meter; the results evidenced an average conductivity of $1.7\times10^{-4}$ (ohm-cm)$^{-1}$ Subsequently, 0.7 gram of the above polymer product particles were dry mixed with 100 grams of an iron Hoeganese core carrier with an average volume bead diameter of 90 microns in a Munson type mixer at room temperature. The coated materials were then fused on the surface of the carrier at 400° F. in a rotary kiln furnace. The product was sieved through a 177 micron screen to remove coarse materials. The functional evaluation of the resulting carrier in a xerographic test fixture similar to the Xerox Corporation 1075 with a two component development system evidences a triboelectric charge (tribo) of 12.0 microcoulombs per gram as determined by the Faraday Cage method against red toner, 90 weight percent of styrene butadiene copolymer, 9 percent of LITHOL SCARLET RED™ and 1 percent of the charge enhancing additive distearyl dimethyl ammonia methyl sulfate (DDAMS). The conductivity of the carrier as determined by forming a 0.1 inch long magnetic brush of the carrier particles, and measuring the conductivity by imposing a 10 volt potential across the brush was $3.2\times10^{-7}$ (ohm-cm)$^{-1}$.

EXAMPLE II

The procedure of Example I was repeated except that the ratio of conductive polymethylmethacrylate particles to KYNAR® particles used was 100/43. The resulting carrier had a triboelectric charge (tribo) of 16.5 microcoulombs per gram as determined by the Faraday Cage method against red toner, 90 weight percent of styrene butadiene copolymer, 9 percent of LITHOL SCARLET RED™ and 1 percent of distearyl dimethyl ammonia methyl sulfate (DDAMS). The conductivity of the carrier as determined by forming a 0.1 inch long magnetic brush of the carrier particles, and measuring the conductivity by imposing a 10 volt potential across the brush was $3.2\times10^{-7}$ (ohm-cm)$^{-1}$.

EXAMPLE III

The procedure of Example I was repeated except that the ratio of conductive polymethylmethacrylate particles to KYNAR® particles used was 100/25. The resulting carrier had a triboelectric charge (tribo) of 21.7 microcoulombs per gram as determined by the Faraday Cage method against red toner, 90 weight percent of styrene butadiene copolymer, 9 percent of LITHOL SCARLET RED® and 1 percent of distearyl dimethyl ammonia methyl sulfate (DDAMS). The conductivity of the carrier as determined by forming a 0.1 inch long magnetic brush of the carrier particles, and measuring the conductivity by imposing a 10 volt potential across the brush was $3.3\times10^{-7}$ (ohm-cm)$^{-1}$.

EXAMPLE IV

The procedure of Example I was repeated except that the ratio of conductive polymethylmethacrylate particles to KYNAR® particles used was 100/11. The resulting carrier had a triboelectric charge (tribo) of 27.2 microcoulombs per gram as determined by the Faraday Cage method against red toner, 90 weight percent of styrene butadiene copolymer, 9 percent of LITHOL 5CARLET RED™ and 1 percent of distearyl dimethyl ammonia methyl sulfate (DDAMS). The conductivity of the carrier as determined by forming a 0.1 inch long magnetic brush of the carrier particles, and measuring the conductivity by imposing a 10 volt potential across the brush was $3.5\times10^{-7}$ (ohm-cm)$^{-1}$.

EXAMPLE V

The process of Example I was repeated except that styrene monomer was used instead of methyl methacrylate. The resulting product had an average particle size of 0.6 micron. The resulting carrier had a triboelectric charge of 3.1 microcoulombs per gram as determined by the Faraday Cage method against red toner, 90 weight percent of styrene butadiene copolymer, 9 percent of LITHOL SCARLET RED™ and 1 percent of distearyl dimethyl ammonia methyl sulfate (DDAMS). The conductivity of the carrier as determined by forming a 0.1 inch long magnetic brush of the carrier particles, and measuring the conductivity by imposing a 10 volt potential across the brush was $2.6\times10^{-7}$ (ohm-cm)$^{-1}$.

EXAMPLE VI

The procedure of Example I was repeated except that 150 grams of T30B™ emulsion obtained from E. I. DuPont Polymer Products, Wilmington, Del. was used in place of KYNAR 3200®. The resulting carrier had a triboelectric charge (tribo) of 13.3 microcoulombs per gram as determined by the Faraday Cage method against red toner, 90 weight percent of styrene butadiene copolymer, 9 percent of LITHOL SCARLET RED™ and 1 percent of distearyl dimethyl ammonia methyl sulfate (DDAMS). The conductivity of the carrier as determined by forming a 0.1 inch long magnetic brush of the carrier particles, and measuring the conductivity by imposing a 10 volt potential across the brush was $3.1\times10^{-7}$ (ohm-cm)$^{-1}$.

EXAMPLE VII

The procedure of Example I was repeated except that 185 grams of TEFLON FEP-120™ emulsion (54 percent solids) obtained from E. I. DuPont Polymer Products, Wilmington, Del. were used in place of KYNAR 3200®. The resulting carrier had a triboelectric charge (tribo) of 8.5 microcoulombs per gram as determined by the Faraday Cage method against red toner, 90 weight percent of styrene butadiene copolymer, 9 percent of LITHOL SCARLET RED™ and 1 percent of distearyl dimethyl ammonia methyl sulfate (DDAMS). The conductivity of the carrier as determined by forming a 0.1 inch long magnetic brush of the carrier particles, and measuring the conductivity by imposing a 10 volt potential across the brush was $3.0\times10^{-7}$ (ohm-cm)$^{-1}$.

EXAMPLE VIII

To 6 kilograms of methyl methacrylate monomer were added 400 grams of 2,2'-azobis(2,4-dimethyl valeronitrile), 80 grams of benzoyl peroxide and 30 grams of divinyl benzene crosslinking agent, which are mixed in a pilot plant scale 10 liter reactor equipped with air driven agitator and controlled heating and cooling capacity until the initiators are dissolved. This mixture was bulk polymerized by heating to 45° C. until 15 weight percent of monomer was converted to polymer. 1.5 Kilograms of Columbian CONDUCTEX 975™ carbon black were added and stirred until all the carbon black was wetted. The contents of the reactor were transferred to the particle formation equipment, a 10 gallon capacity homogenizer, and cooled to 15° C. Also, added to the homogenizer was the aqueous phase of 22 kilograms of water containing 4 weight percent of polyvinyl alcohol having a weight average molecular weight of 3,000. The mixture was homogenized for 2 minutes to produce a microsuspension of polymeric materials containing carbon black in water. A quantity of 10 grams of potassium iodide was then added as an aqueous phase inhibitor. The resulting microsuspension was transferred to a pilot plant 10 gallon reactor equipped with cascade temperature control. The suspension polymerization temperature was raised from 25° to 60° C. in 35 minutes where it was held for 2 hours, then the temperature was increased to 85° C. in 120 minutes and held there for 1 hour; 27.8 kilograms of KYNAR 3200® emulsion (18 percent solids) were then added to the suspension and the entire mixture transferred to a rotor-stator type homogenizer where it was homogenized for 10 minutes. The product was then washed with methanol and water as described in Example I using a pilot scale centrifuge and dried in a fluidized bed dryer. The resulting product had an average particle size of 0.7 micron. The carbon black content of the product was 15.1 percent. The functional evaluation of the resulting carrier in the xerographic test fixture with a two component development system indicated a triboelectric charge of 11.8 microcoulombs per gram against the red toner. The conductivity of the carrier was 3.3E-7 (ohm-cm)$^{-1}$.

The following Comparative Examples are intended to illustrate the significant difference in behavior between blending different types of dry particles with the process illustrated in the present application. One primary advantage of the present invention is minimal conductivity loss when blending with insulative contrast polymers, for example less than 1 to 2 orders of magnitude. This represents an advantage of 2 to 4 orders of magnitude of coating conductivity.

COMPARATIVE EXAMPLE 1

The procedure of Example I was repeated except that KYNAR® polymer particles were not blended with the conductive polymethyl methacrylate particles. The resulting product had an average particle size of 0.7 micron. The functional evaluation of the resulting carrier in the xerographic test fixture with a two component development system indicated a triboelectric charge of 32.1 microcoulombs per gram against the red toner. The conductivity of the carrier was 3.5E-7 (ohm-cm)$^{-1}$.

COMPARATIVE EXAMPLE 2

The procedure of Comparative Example 1 was repeated except that dry KYNAR® polymer particles were blended with the dried conductive polymethylmethacrylate particles prepared in Comparative Example 1 in the ratio of 100/67. The functional evaluation of the resulting carrier in the xerographic test fixture with a two component development system indicated a triboelectric charge of −6.0 microcoulombs per gram against the red toner. The conductivity of the carrier was 1.0E-8 (ohm-cm)$^{-1}$.

COMPARATIVE EXAMPLE 3

The procedure of Comparative Example 1 was repeated except that dry KYNAR® polymer particles were blended with the dried conductive polymethylmethacrylate particles prepared in Comparative Example 1 in the ratio of 100/43. The functional evaluation of the resulting carrier in the xerographic test fixture with a two component development system indicated a triboelectric charge of + 4.0 microcoulombs per gram against the red toner. The conductivity of the carrier was 1.9E-8 (ohm-cm)$^{-1}$.

COMPARATIVE EXAMPLE 4

The procedure of Comparative Example 1 was repeated except that dry KYNAR® polymer particles were blended with the dried conductive polymethylmethacrylate particles prepared in Comparative Example 1 in the ratio of 100/25. The functional evaluation of the resulting carrier in the xerographic test fixture with a two component development system indicated a triboelectric charge of + 14.6 microcoulombs per gram against the red toner. The conductivity of the carrier was 4.7E-8 (ohm-cm)$^{-1}$.

COMPARATIVE EXAMPLE 5

The procedure of Comparative Example 1 was repeated except that dry KYNAR® polymer particles were blended with the dried conductive polymethylmethacrylate particles prepared in Comparative Example 1 in the ratio of 100/11. The functional evaluation of the resulting carrier in the xerographic test fixture with a two component development system indicated a triboelectric charge of + 23.9 microcoulombs per gram against the red toner. The conductivity of the carrier was 7.8E-8 (ohm-cm)$^{-1}$.

Other modifications of the present invention may occur to those skilled in the art subsequent to a review of the present application. The aforementioned modifications, including equivalents thereof, are intended to be included within the scope of the present invention.

What is claimed is:

1. A process for the preparation of conductive, electronegative, submicron polymeric particles comprised of a first polymer selected in an amount of from about 1 to about 99 weight percent and containing from about 1 to about 50 percent by weight of a conductive filler and a second electronegative, contrast polymer, and wherein said conductive polymer particles with optional filler are prepared by mixing at least one monomer with a polymerization initiator, a crosslinking component and a chain transfer component; effecting bulk polymerization at a temperature of from about 45° C. to about 120° C. until from about 5 to about 50 weight percent of the monomer has been polymerized; terminating polymerization by cooling the partially polymerized monomer; adding thereto from about 1 to about 50 weight percent of a conductive filler followed by mixing thereof; dispersing the resulting mixture of conductive filler, and partially polymerized product in water containing a stabilizing component to obtain a suspension of particles with an average diameter of from about 0.05 to about 1 micron in water; polymerizing the resulting suspension at a temperature of from about 45° C. to about 120° C. by heating; adding a second contrast polymer emulsion, suspension or fine dispersion in an amount of from about 1 to about 99 weight percent for said polymer with high shear mixing; and optionally subsequently washing and drying the polymer particles obtained.

2. A process in accordance with claim 1 wherein a mixture of monomers is selected.

3. A process in accordance with claim 2 wherein the mixture contains from 2 monomers to about 20 monomers.

4. A process in accordance with claim 1 wherein the bulk and the suspension polymerization are accomplished by heating.

5. A process in accordance with claim 4 wherein heating is accomplished at a temperature of from about 30° C. to about 130° C.

6. A process in accordance with claim 1 wherein carrier particles are formed by the dry mixing of carrier core particles with the conductive polymer particles comprising the first and second contrast polymer for a sufficient period of time to permit said polymer particles to mechanically adhere to said carrier core particles; heating the mixture of carrier core particles and conductive polymer particles to a temperature of between about 100° C. to about 550° C. whereby said conductive polymer particles melt and fuse on the carrier core particles, and wherein the conductive polymer particles form a coating on said carrier core particles on from about 10 to 100 percent of the surface thereof; and thereafter cooling the resulting carrier particles.

7. A process in accordance with claim 6 wherein fusing is accomplished at a temperature of from about 200° C. to about 350° C.

8. A process for the preparation of conductive, electronegative, submicron polymeric particles consisting essentially of a first polymer selected in an amount of from about 1 to about 99 weight percent containing from about 1 to about 50 percent by weight of a conductive filler and a second electronegative, contrast polymer, and wherein said conductive polymer particles with filler are prepared by mixing at least one monomer with a polymerization initiator, a crosslinking component and a chain transfer component; effecting bulk polymerization at a temperature of from about 45° C. to about 120° C. until from about 5 to about 50 weight percent of the monomer has been polymerized; terminating polymerization by cooling the partially polymerized monomer; adding thereto from about 1 to about 50 weight percent of a conductive filler, followed by mixing thereof; dispersing the resulting mixture of conductive filler, and partially polymerized product in water containing a stabilizing component to obtain a suspension of particles with an average diameter of from about 0.05 to about 1 micron in water; polymerizing the resulting suspension at a temperature of from about 45° to about 120° C. by heating; adding a second contrast polymer emulsion in an amount of from about 1 to about 99 weight percent with high shear mixing; and subsequently washing and drying the polymer particles obtained.

9. A process in accordance with claim 6 wherein from about 0.01 weight percent to about 1.5 weight percent of conductive submicron polymer is selected.

10. A process in accordance with claim 6 wherein the carrier cores are comprised of steel or ferrites, and the conductive polymers are comprised of polymethylmethacrylates and carbon black.

11. A process in accordance with claim 10 wherein the ferrites are comprised of copper and zinc; or copper, zinc, and magnesium.

12. A process in accordance with claim 6 wherein the carrier particles have an average volume diameter of from between about 30 to about 300 microns.

13. A process in accordance with claim 1 wherein the conductive polymeric particles obtained have an average particle diameter of from about 0.05 micron to about 1 micron.

14. A process in accordance with claim 1 wherein the ratio of conductive filler to the polymer in the final product is from about 0.01 to about 1, and the conductive polymer product has a conductivity of $10^{-2}$ to about $10^{-10}$ (ohm-cm)$^{-1}$.

15. A process in accordance with claim 1 wherein the conductivity of the conductive polymer particle product is from about $10^{-4}$ to $10^{-7}$ (ohm-cm)$^{-1}$.

16. A process in accordance with claim 1 wherein the first polymer is nonfluorinated and contains a linear portion, and the number and weight average molecular weight of the linear portion is between about 5,000 to about 500,000.

17. A process in accordance with claim 6 wherein the triboelectrical charge of the carrier particles is from about +40 to about −40 microcoulombs per gram.

18. A process in accordance with claim 6 wherein there is mixed the carrier core particles (1) with said conductive polymer particles comprising the first and second contrast polymer with from about 10 to about 90 percent by weight of the first polymer, and from about 90 to about 10 percent by weight of the second contrast polymer; (2) dry mixing the carrier core particles and the conductive polymer particles for a sufficient period of time enabling the conductive polymer particles to adhere to the carrier core particles; (3) heating the mixture of carrier core particles and conductive polymer particles to a temperature of between about 200° C. and about 550° C., whereby the conductive polymer particles melt and fuse to the carrier core particles; and (4) thereafter cooling the resulting coated carrier particles, wherein the first polymer and second contrast polymer are not in close proximity thereto in the triboelectric series, and the first and second contrast polymers are selected from the group consisting of polystyrene and tetrafluoroethylene; polyethylene and tetrafluoroethylene; polyethylene and polyvinyl chloride; polyvinyl acetate and tetrafluoroethylene; polyvinyl acetate and polyvinyl chloride; polyvinyl acetate and poly(p-fluorostyrene); and polyvinyl acetate and polymethyl methacrylate.

19. A process in accordance with claim 1 wherein the filler is selected from the group consisting of conductive carbon blacks, metal oxides, metals, and mixtures thereof.

20. A process in accordance with claim 1 wherein the filler is selected from the group consisting of acetylene black, iron oxides, TiO, $SnO_2$, and iron powder.

21. A process in accordance with claim 1 wherein the contrast suspension polymer has an $M_w$ of from about 25,000 to about 2,000,000.

22. A process in accordance with claim 1 wherein the contrast polymer is a fluoropolymer with an $M_w$ of from about 10,000 to about 500,000.

23. A process in accordance with claim 1 wherein the contrast polymer is present in an amount of from about 10 to about 70 weight percent.

24. A process in accordance with claim 1 wherein the contrast polymer is a fluorinated or chlorinated polyolefin formulated from an emulsion or aqueous suspension containing 10 to 60 parts by weight of polymeric solids.

25. A process in accordance with claim 1 wherein the contrast polymer is the fluorinated or the chlorinated polyolefin polyvinylidenefluoride, polyvinylfluoride, polyvinyl-chloride, polytetrafluoroethylene; copolymers thereof; or polymers and/or copolymers of the fluorinated or chlorinated styrenes p-chlorostyrene, o-chlorostyrene, p-fluorostyrene, o-fluorostyrene, pentafluorostyrene, and allyl pentafluorobenzene; and/or the copolymers of fluorinated or chlorinated methacrylates of acrylates of trifluoroethylacrylate, trifluoroethylmethacrylate, pentafluorophenylacrylate, pentafluorophenylmethacrylate, hexafluoroisopropylacrylate, hexafluoroisopropylmethacrylate, tetrafluoropropylacrylate, tetrafluoropropylmethacrylate, perfluorooctylacrylate, or perfluorooctylmethacrylate.

26. A process in accordance with claim 6 wherein the triboelectrical charge of the carrier particles is from about +10 to about −20 microcoulombs/gram.

27. A process for preparation of conductive, electronegative, submicron polymeric particles, subsequently used in the preparation of carrier particles, and wherein said submicron polymeric particles are comprised of a first polymer containing from about 1 to about 50 percent by weight of a conductive filler and a second electronegative, contrast polymer, and wherein said conductive polymer particles with filler is prepared by mixing at least one monomer with a polymerization initiator, a crosslinking component and a chain transfer component; effecting bulk polymerization until from about 5 to about 50 weight percent of the monomer has been polymerized; terminating polymerization by cooling the partially polymerized monomer; adding thereto from about 1 to about 50 weight percent of a conductive filler, followed by mixing thereof; dispersing the resulting mixture of said conductive filler, and partially polymerized product in water containing a stabilizing component to obtain a suspension of particles with an average diameter of from about 0.05 to about 1 micron in water; polymerizing the resulting suspension by heating; adding a second contrast polymer emulsion, suspension or fine dispersion with a high shear mixer; subsequently washing and drying the product; thereafter heating a carrier core or carrier cores and the resulting conductive polymer particle blend to enable fusing thereof to said core or cores; and cooling the carrier particles obtained, which carrier particles have a conductivity of from between about $10^{-4}$ to about $10^{-10}$ (mho-cm$^{-1}$).

* * * * *